US006234701B1

(12) United States Patent
Karten et al.

(10) Patent No.: US 6,234,701 B1
(45) Date of Patent: May 22, 2001

(54) MOLDED PLASTIC BINDER

(75) Inventors: Stuart Karten; Paul Kirley, both of Venice; Dennis Schroeder, Hermosa Beach, all of CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/394,725

(22) Filed: Sep. 13, 1999

Related U.S. Application Data

(63) Continuation-in-part of application No. 09/167,348, filed on Oct. 7, 1998, now Pat. No. 6,030,140.

(51) Int. Cl.[7] ..... B42F 13/00

(52) U.S. Cl. ..... 402/73; 402/70; 402/77; 402/62; 402/80 P; 402/24; 402/80 R; 281/20

(58) Field of Search ..... 281/20; 402/70, 402/80 R, 80 P, 73, 77, 62, 21, 24

(56) References Cited

U.S. PATENT DOCUMENTS

| | | | | |
|---|---|---|---|---|
| 0,442,231 | | 12/1890 | Lieker . | |
| 0,781,948 | | 2/1905 | Hegele . | |
| 1,009,071 | | 11/1911 | Jensen . | |
| 1,204,387 | | 11/1916 | Akans . | |
| 1,617,958 | * | 2/1927 | Mc Lean . | |
| 1,887,530 | | 11/1932 | Trussell . | |
| 2,078,098 | | 4/1937 | Parkin . | |
| 2,155,203 | | 4/1939 | Polacsek . | |
| 2,363,848 | | 11/1944 | Emmer . | |
| 2,364,859 | | 12/1944 | Lichtenstein . | |
| 2,687,157 | | 8/1954 | Cowan . | |
| 2,804,872 | * | 9/1957 | Kraut . | |
| 3,008,470 | | 11/1961 | Rubinstein . | |
| 3,087,498 | | 4/1963 | Vogel . | |
| 3,154,281 | * | 10/1964 | Frank | 248/201 |
| 3,331,373 | | 7/1967 | Lohmeier . | |
| 3,343,709 | | 9/1967 | Henderson . | |
| 3,771,890 | | 11/1973 | Notto . | |
| 3,891,070 | | 6/1975 | Montanari . | |
| 3,910,708 | | 10/1975 | Rohner . | |
| 3,936,202 | | 2/1976 | Brajituli . | |
| 4,056,326 | * | 11/1977 | Crawford | 402/30 |
| 4,058,327 | | 11/1977 | Sullivan et al. . | |
| 4,306,737 | | 12/1981 | Errichiello . | |
| 4,571,109 | | 2/1986 | Lapertosa . | |
| 4,588,321 | | 5/1986 | Egly . | |
| 4,595,309 | | 6/1986 | Chinchar . | |
| 4,603,995 | * | 8/1986 | Vilona | 402/73 |
| 4,623,276 | * | 11/1986 | Kinneir | 402/76 |
| 4,718,550 | | 1/1988 | Johnson . | |
| 4,744,689 | * | 5/1988 | Sternberg | 402/73 |
| 4,749,098 | | 6/1988 | Verdi . | |
| 4,750,884 | * | 6/1988 | Bourgeois et al. | 402/75 |
| 4,848,498 | * | 7/1989 | Moor | 281/31 |
| 4,865,483 | | 9/1989 | Snook . | |
| 4,904,104 | | 2/1990 | Gloeckle . | |
| 4,932,679 | | 6/1990 | Mayer et al. . | |

(List continued on next page.)

*Primary Examiner*—A. L. Wellington
*Assistant Examiner*—Alisa L Thurston
(74) *Attorney, Agent, or Firm*—Oppenheimer Wolff & Donnelly LLP

(57) ABSTRACT

An improved binder formed of two cover portions made of rigid material joined together with a living hinge is disclosed. A closure flap with a second living hinge joins the free ends of the cover opposite the binder spine. An improved method of attaching a pocket to the binder is also disclosed. The use of such a technique on rigid polypropylene material allows roll feeding of materials, eliminates the need for a chipboard, allows existing printing and sealing machinery to be employed in the manufacture of the binder, and provides improved durability and aesthetics at a low cost. One cover portion may be adapted with number design features to properly align one cover portion relative to the other cover portion. A pocket formed of rigid material may also be coupled to one of the cover portions.

21 Claims, 10 Drawing Sheets

U.S. PATENT DOCUMENTS

| | | | | |
|---|---|---|---|---|
| 4,962,949 | | 10/1990 | Gibbs . | |
| 5,028,075 | | 7/1991 | Donnelly . | |
| 5,030,027 | | 7/1991 | Bachrach et al. . | |
| 5,174,674 | | 12/1992 | Norwood . | |
| 5,209,593 | | 5/1993 | Ros . | |
| 5,222,825 | | 6/1993 | Wyant . | |
| 5,236,226 | * | 8/1993 | Sheffield | 281/48 |
| 5,340,156 | * | 8/1994 | Bianco | 281/37 |
| 5,394,981 | | 3/1995 | Cameron . | |
| 5,575,504 | | 11/1996 | Wagner . | |
| 5,607,246 | * | 3/1997 | Podosek | 402/73 |
| 5,651,628 | * | 7/1997 | Bankes et al. | 402/73 |
| 5,749,464 | | 5/1998 | Cheris et al. . | |
| 5,752,589 | | 5/1998 | Berg . | |
| 5,971,650 | * | 10/1999 | Dottel | 402/73 |
| 6,024,508 | * | 2/2000 | Lippeth | 402/73 |
| 6,027,275 | * | 2/2000 | Williams | 402/80 R |
| 6,039,494 | * | 3/2000 | Pearce | 402/73 |

* cited by examiner

MOLDED PLASTIC BINDER

RELATED APPLICATION

This is a continuation-in-part application of pending application Ser. No. 09/167,348, filed Oct. 7, 1998, now U.S. Pat. No. 6,030,140, which is hereby incorporated by reference into this application.

BACKGROUND OF THE INVENTION

1. Field of Invention

The present invention relates generally to multi-ring binders for the educational market.

2. Description of Related Art

Three-ring binders made of a flexible outer jacket having a spine with a metal three ring clip are known in the art. The edges of such multi-ring binders are sometimes held together with Velcro or other such hook-and-loop fasteners Many schools have banned such hook-and-loop fastener binders because school children make excessive noise opening and closing these binders.

In addition, when mass-producing binders unit costs must be kept as low as possible, while maintaining a high quality look and feel to the binder. One area of cost involves the need to cut and size plastic stock used to make binders on conventional RF welding binder machinery.

Further, it has been found that users prefer the texture, thermal conductivity, resiliency and look and feel of certain materials. Consumers are willing to pay a premium for products that are aesthetically pleasing to the touch. Further, consumers are also willing to pay a premium for products that are more durable, and have a sleek look to them, such as for products made from injection molded polypropylene.

At the same time, consumers want binders that are easy to use and durable. That is, the injection molded binder should open and close easily and be well constructed to withstand the stress of repeated use by a user. In particular, some injection molded binders have a pocket made of extruded film designed to hold sheets of paper. However, after some use, the pocket made of extruded film is too weak to hold sheets of paper. In other words, the extruded film pocket is not rigid enough to hold sheets of paper. Furthermore, after some use, the extruded film pocket tends to rip.

Thus, there still is a need for a binder made of injection molded plastic that is easy to use, reliable, and which has a pocket capable of holding sheets of paper for an extended period of time.

SUMMARY OF THE INVENTION

Accordingly, the object of the present invention is to provide an improved three-ring binder that solves the above mentioned problems using both improved materials and improved mechanical design.

The present invention discloses a plastic binder that is made from plastic material, preferably injection molded polypropylene, in a novel configuration, that is both easier to manufacture in a single pass operation using existing machinery, which holds down unit costs, as well as being aesthetically pleasing.

The present design of an embodiment of the present invention, involving a pocket and living hinge latch and fastener, has numerous features and advantages, including but not limited to:

- a non-Velcro type fastener, which makes less noise when opening;

- a living hinge fastener or binder closure that is manufactured on the first pass of a production process;
- the incorporation of a pocket manufactured on a roll process, rather than cut from one or more sheets, to incorporate the pocket into the binder on the first pass of a production process;
- the use of a perforated mechanism for attachment of a pocket allows a press operator to easily attach the pocket by snapping it to the binder cover during the press operator's down time, avoiding the need for an additional assembly line process;
- a contemporary, aesthetically pleasing design is made without excessive weld lines, bumps or creases;
- the use of a strong, rigid material, such as injection molded polypropylene, combines an impression of durability and aesthetics;
- the use of a rigid polypropylene shell as one of the binder covers in a unitary, one-piece manner eliminates the need for an underlying inner chipboard for strength;
- the use of dual soft and hard textures on the cover, which aid to aesthetics and have utilitarian functions;
- cover portions may be provided with a number of design features to properly align one cover portion to the other cover portion;
- a pocket formed of injection molded plastic may be ultrasonically welded to one of the covers.

The sum total of all of the above advantageous, as well as the numerous other advantages disclosed and inherent from the invention described herein increases consumer satisfaction and helps expand the market for binders throughout, especially from the kindergarten to high school level.

The above described and many other features and attendant advantages of the present invention will become apparent from a consideration of the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

Disclosed herein is a detailed description of the best presently known mode of carrying out the invention. This description is not to be taken in a limiting sense, but is made merely for the purpose of illustrating the general principles of the invention. The section titles and overall organization of the present detailed description are for the purpose of convenience only and are not intended to limit the present invention.

Figure 1:
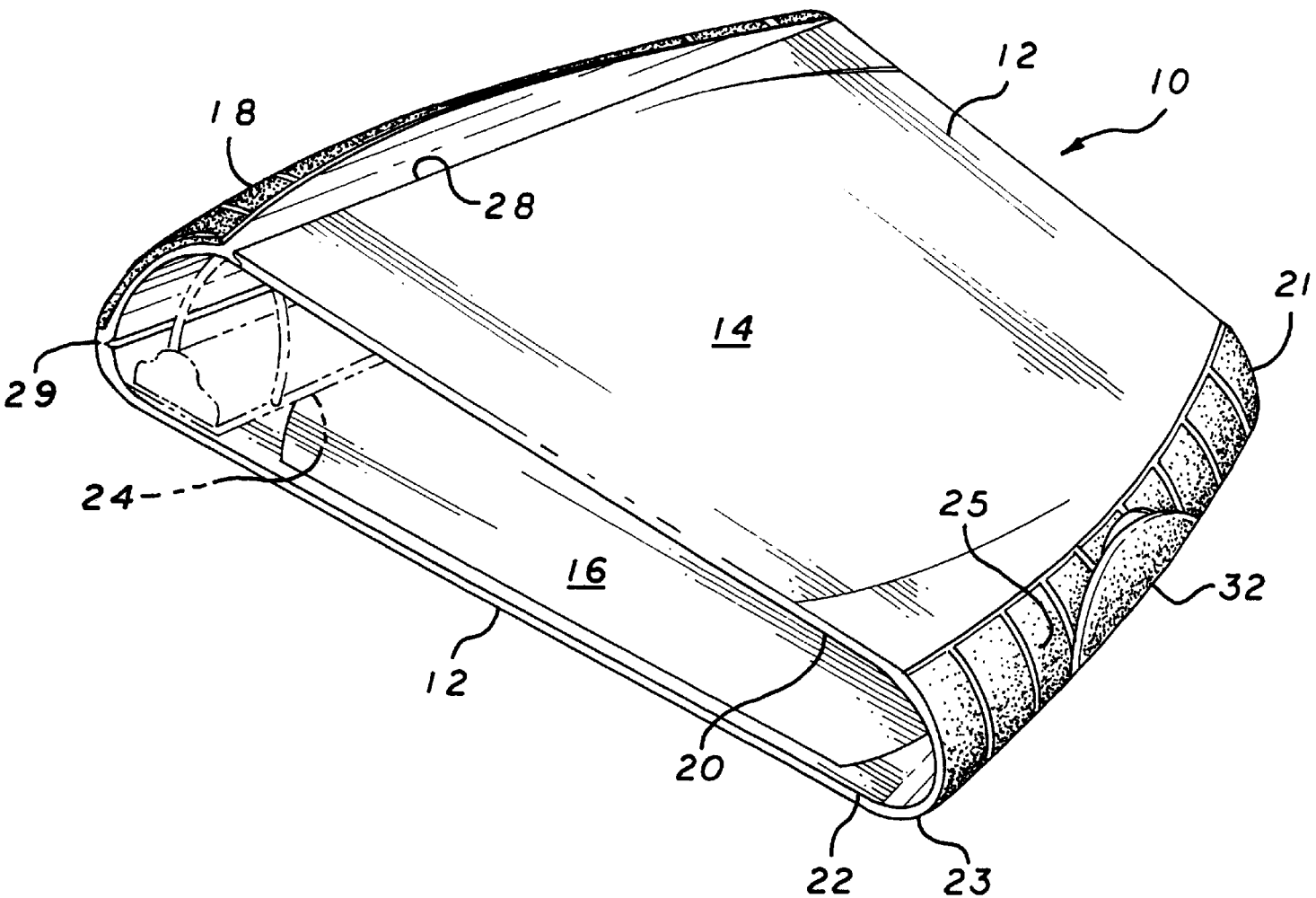
FIG. 1 is a perspective plan view of the present invention, a binder.
Figure 8:
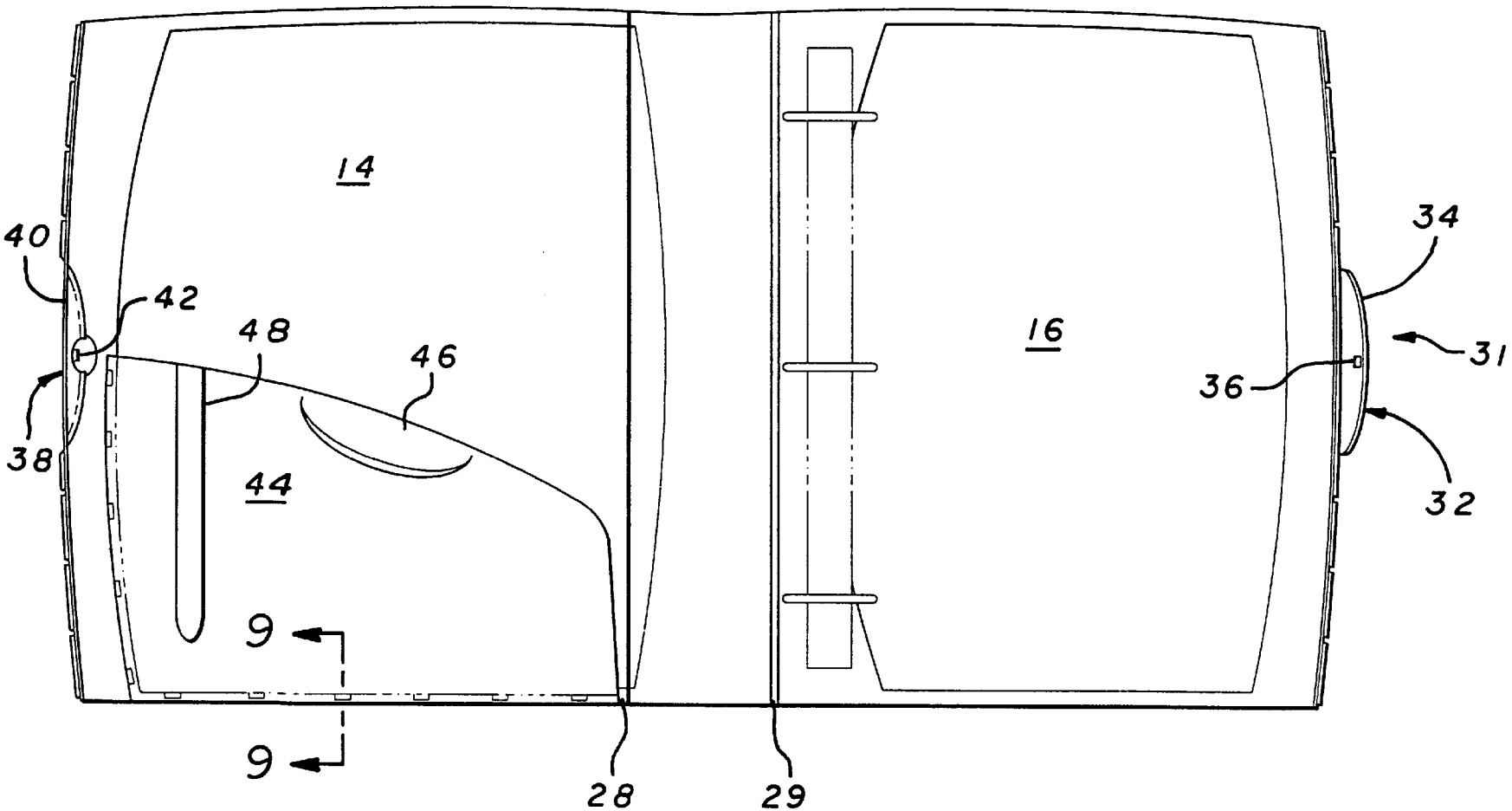
FIG. 8 is a front view of the binder of FIG. 1 opened.

FIGS. 1–11 disclose the binder of the present invention. The binder 10 has a cover 12, with front or top portion 14, which has an outside side (as shown in FIG. 1) and an inside side (as shown in FIG. 8), and a similar back or bottom portion 16, with similar outside and inside sides. The cover has a spine 18 in between the two covers, and free open end edges 20, 22, which may be curved into mating end portions 21, 23. A three-ring metal latch or clip 24, for holding paper, is attached to the back cover 16 to allow the rings to face upwards, as shown, or, alternatively, to the spine. One such metal latch is described in U.S. Pat. No. 5,354,142, incorporated herein. Other designs, such as a clasp or clamp, can be used to hold paper.

Crease lines 28, 29 form a living hinge between the front and back covers and the spine of the binder. The living hinge lines 28, 29 may be formed of the same material as the cover, e.g., in a preferred embodiment injection molded polypropylene material, or, may be formed of a different material fastened to the material forming the cover, such as plastic tape.

At the shaded portions shown in FIG. 1, such as shown by dotted shading 25, a soft, thin layer of vinyl, rubber or thermoplastic material (such as TPR) may be adhesively secured to the underlying polypropylene, to provide a non-skid surface and for aesthetic reasons. Similarly, for aesthetic reasons and to convey information the polypropylene may be imprinted with printed matter or colors. When employing polypropylene as a material, the inks used may be of the same kind used by machinery for imprinting vinyl.

The binder has open edges 20, 22 held closed by a closure fastener flap mechanism 31. The open ends 20, 22 have flap portions 21, 23, which may be rigid extensions of the covers 14, 16 respectively (i.e., the flaps may be the covers 14, 16 curved at the open ends to meet together) engaged by the closure flap mechanism 32 to better seal the contends of the binder and prevent documents from falling out.

Regarding the closure fastener or binder closure, a lower clasp or semicircular lower flap 32, which may be formed of the same material as the cover, has a single latch protrusion 36 which extends from the lower flap 32 at right angles. The flap 32 is attached to the lower cover 16 through a living hinge. The living hinge may be formed from the same material constituting the lower cover 16 and lower flap 32, or, may be formed of a different, more flexible material to join together the more rigid lower cover and flap materials, which in a preferred embodiment are made of injection molded polypropylene material.

Figure 2:
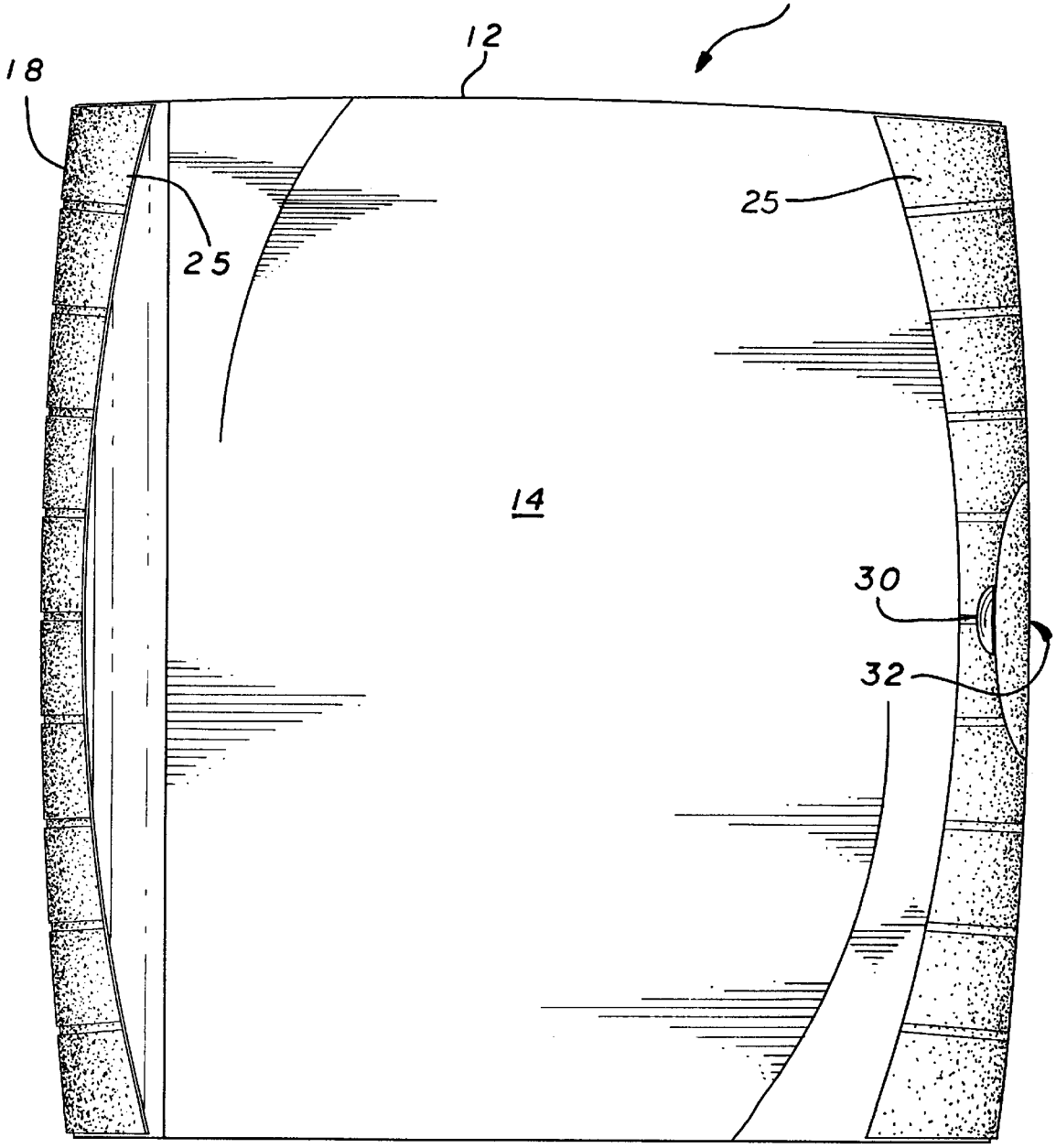
FIG. 2 is top view of the binder shown in FIG. 1.
Figure 3:
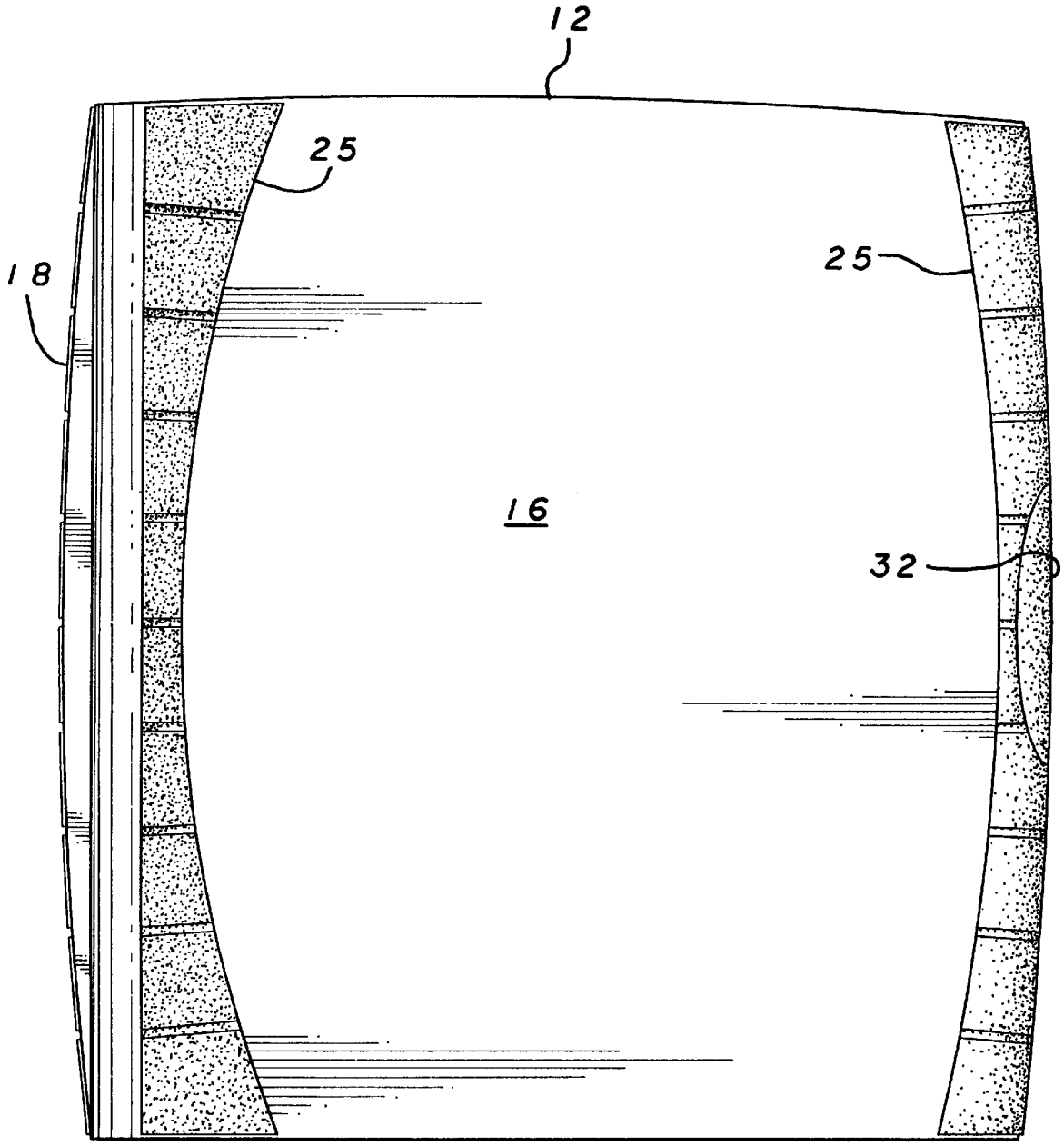
FIG. 3 is a bottom view of the binder shown in FIG. 1.
Figure 4:
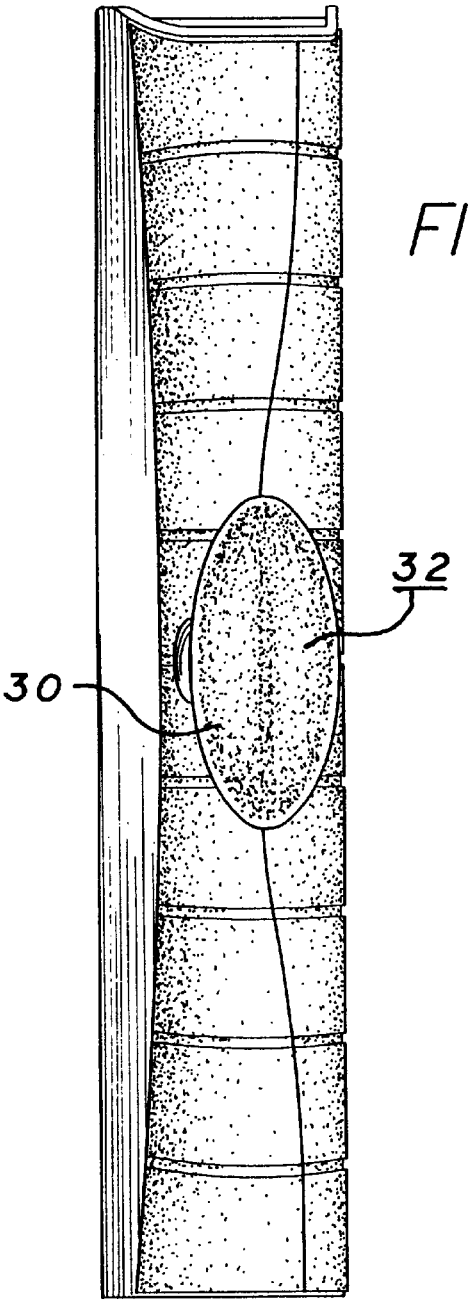
FIG. 4 is a right side view of the binder shown in FIG. 1.
Figure 5:
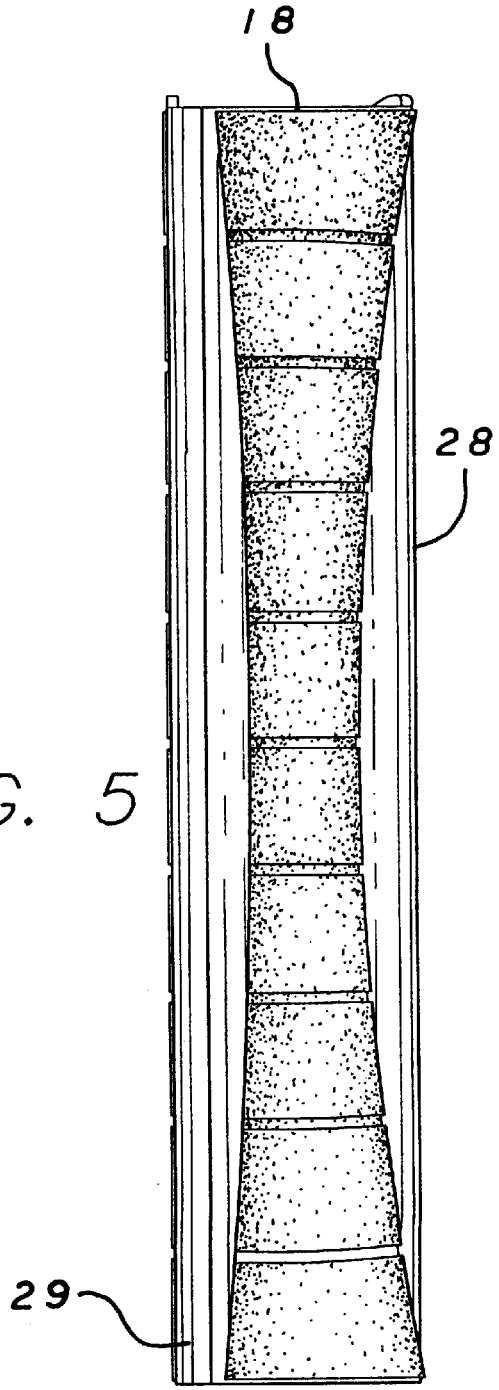
FIG. 5 is a left side view of the binder shown in FIG. 1.
Figure 6:
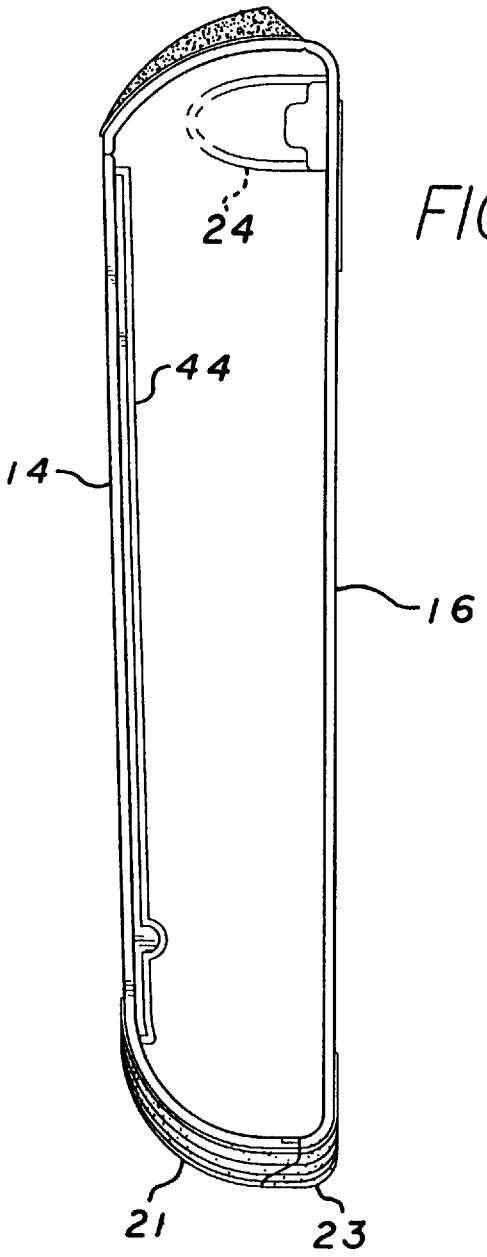
FIG. 6 is a top end view of the binder shown in FIG. 1.
Figure 7:
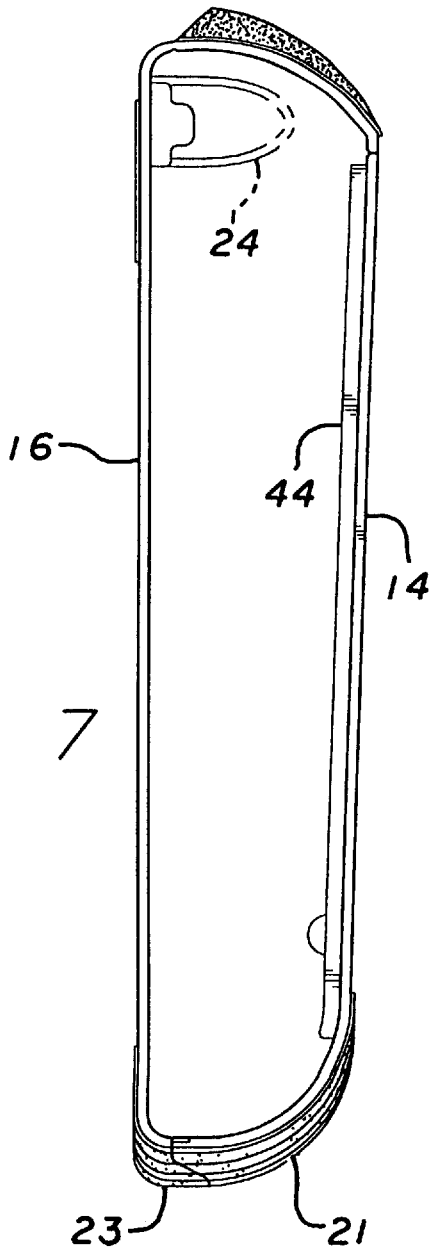
FIG. 7 is a bottom end view of the binder shown in FIG. 1.

Protrusion 36 is received by a latch aperture or depression 42 found in the mating semicircular recessed depression 40. The depression 40 contains a thumb well 30 for allowing a user to engage the tip of one's finger in the thumb well 30 and disengage the binder closure lower flap 32. The semicircular recessed depression 40 is molded into the upper portion of the binder closure, forming the mating upper fastener portion 38, and receives the lower latch 32. Upper fastener 38 is part of the upper cover portion 14 in the upper flap 21. When protrusion 36 is received within aperture 42, the binder is snapped shut along the open edges 20, 22. The closure flap 32 forms an aesthetic oval shape when viewed from the top and end, as shown in FIGS. 2 and 4. A thumb recess 30 about the aperture 42 allows easy opening of the flap with one's fingernail. The lower flap 32 allows the open ends of the binder to close and gives an aesthetically pleasing look to the binder, as well as protecting the binder more completely.

Figure 11:
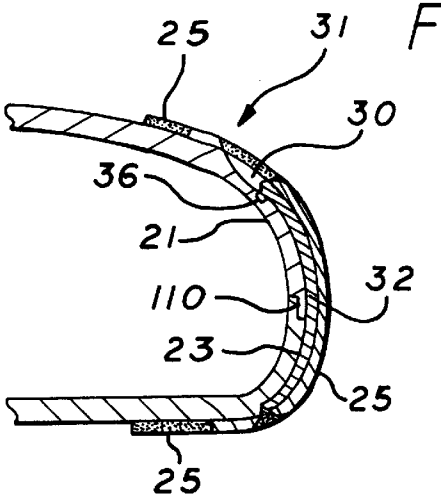
FIG. 11 is a cross sectional view along the binder closure mechanism.

Turning attention to FIG. 11, there is shown the end flaps 21, 23, which meet at a ledge 110, forming a stepped recess. The latch mechanism 31 is shown in the closed position, with lower flap 32 received by the upper fastener portion, and rubber or vinyl surface layer 25 (which has shading as indicated because some of the surface layer 25 is in relief) forming a non-skid and aesthetic surface.

The binder 10 is preferably formed of injection molded polypropylene material, a substantially rigid or semi-rigid material. An optional pocket inlay may be attached to the upper cover through a hook and aperture arrangement as described herein, such as shown by section lines 9—9 in FIG. 9. Pocket 44 has raised finger hold 46 and a pen hold recess 48 molded in it.

Figure 9:
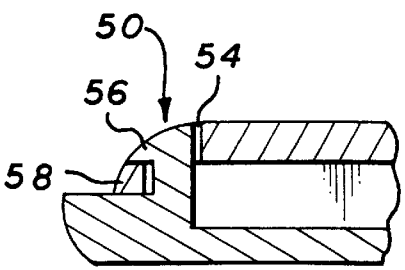
FIG. 9 is a view along the section lines 9—9 in FIG. 8.
Figure 10:
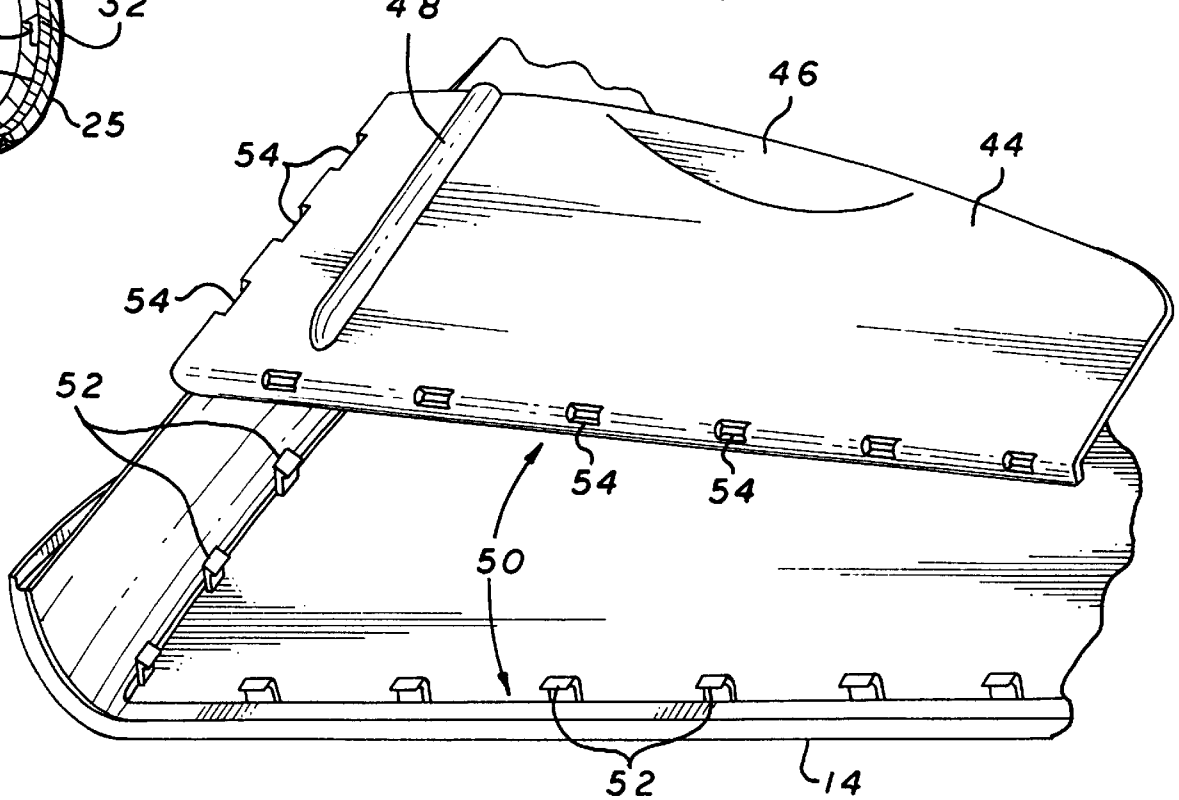
FIG. 10 is a broken view of a pocket inlay for the binder.

In FIGS. 9–10 show how the binder pocket 44 is attached to the upper half portion 14 of the cover 10 during manufacture, by a tooth and aperture arrangement 50, to help form a mechanical interlock. Both pocket 44 and the cover 10 are made of substantially hard material, injection molded polypropylene, which also forms the bottom cover 16. A plurality of hooks or teeth 52 in the cover 14 mate with apertures or recesses 54 in the pocket 44. The hooks are formed with outward hook portions 56 that have a flat surface engaging the flat portion 58 of the pocket 44.

Turning attention now to FIG. 9, there is shown a cross-section 9—9 of a portion of the upper cover 14 of binder 10, which incorporates the hook and aperture seam 50 for holding the pocket 44 to the upper cover 14. The pocket may be on either the outside of the upper cover (not shown) or, as illustrated, on the inside of the upper cover. The inside pocket 44 is generally formed of the same material as the cover, preferably injection molded polypropylene, but optionally may be made of a different material. Furthermore, the pocket 44 may be attached to the binder cover by a press operator during the press operator's down time, in an easy snap fit manner, by taking advantage of the mechanical interlock between the pocket inlay and the cover.

Other pocket designs are contemplated by the present invention, such as, in lieu of a pocket inlay sheet 44 that mechanically interlocks with the cover portion, having a pocket flap that is formed from the same stock roll forming the cover, and attached at the bottom side of the cover (e.g., where section line 9—9 is shown in FIG. 8) by a living hinge, so that the pocket folds about this living hinge attached at the bottom side of the cover. The pocket flap would be prevented from flapping about by being attached at the top of the pocket to the cover (e.g., at the top where finger hold 46 is) by mating studs and holes. This design eliminates the requirement of a separate pocket inlay, at the cost of having to provide a wider stock of material for the cover during assembly (as the pocket inlay would be attached, at its living hinge portion, to the bottom side of the cover at section line 9—9).

The stock forming the binder 10 itself can be cut to size during manufacture using the RF sealing die. The binder, like the pocket, can also be cut to size and shape by the RF sealing die, as both materials are roll fed together in contiguous layers, avoiding the prior techniques of heat sealing of sheets that are fed together by sheet feeding.

Thus, the method of manufacture for the two material binders of the present invention comprises feeding into an RF sealing die a first continuous stock or roll of PVC material, such as injection molded polypropylene. The injection molded polypropylene may come in injection molded form. The injection molded polypropylene forms the cover 10comprising two cover portions of the binder, covers 14, 16, and spine 18. Suitable living hinges, such as at fold lines 28, 29, connect the covers and spine. The living hinge may simply comprise crease or score lines 28, 29 of the same material as the covers 14, 16 and spine (which may be formed of a continuous sheet of material), or, the living hinge may be made of a separate, more flexible material, such as a polypropylene living hinge, which tapes together the three portions of cover 14, cover 16 and spine 10. A second roll of injection molded polypropylene is then used to form the pocket, such as pocket 44 in FIG. 8. As described above, the edges where the two materials forming the cover 14 and pocket 44 meet are joined with mating structures, such as teeth 52 in FIGS. 9–10 mating with apertures 54. The use of such a perforated mechanism for attachment of a pocket allows a press operator to easily attach the pocket by snapping it to the binder cover during the press operator's down time, avoiding the need for an additional assembly line process. The two materials, once aligned so that hook and aperture mate, they can, if desired, be radio frequency (RF) welded, heat sealed, ultrasonically welded, mechanically fastened, interlocked or otherwise further secured together. The cover can be printed on, and PVC is easily imprinted on with existing vinyl binder industry inks and machinery. For final assembly, the metal latch is attached to the cover with nuts and bolts or rivets, or other known technologies.

Figure 12:
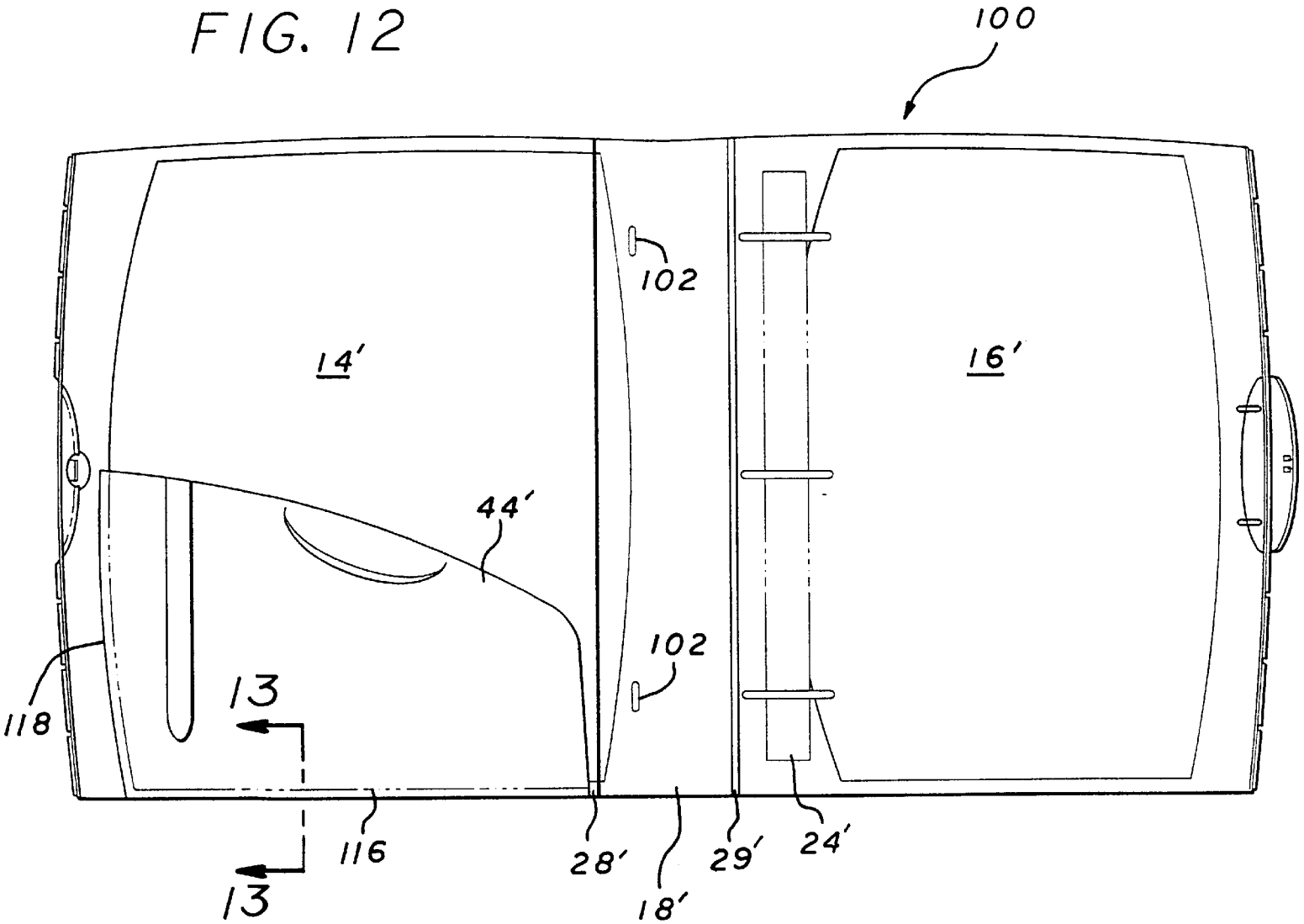
FIG. 12 is an another embodiment of a binder in an open position.
Figure 13:
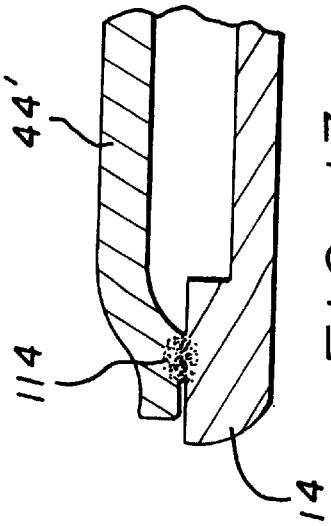
FIG. 13 is a cross sectional view along the section line 13—13 of the binder in FIG. 12.
Figure 14:
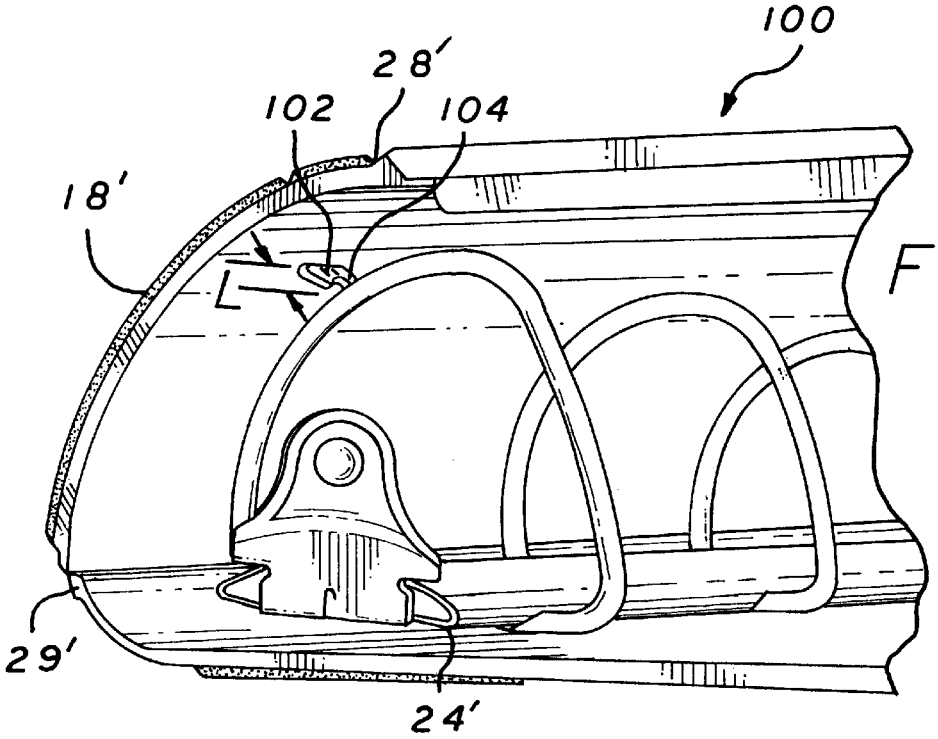
FIG. 14 is an enlarged perspective view of the bottom end of the binder in FIG. 12.

Another embodiment of the present invention is illustrated by way of example in FIGS. 12 through 17. Here, a binder 100 has a number of features designed to make the binder more durable and easier to use. As shown in FIGS. 12 and 14, a pair of guides 102 are coupled to the interior side of the spine 18' (hereinafter primed reference numerals are used to indicate similar elements as described in FIGS. 1 through 11 in the previous embodiment). As best shown in FIG. 14, the pair of guides are positioned to mate with the top and bottom rings of the three ring metal latch mechanism 24' as the top cover 14' is closed relative to the bottom cover 16'. The guides ensure that the top cover is properly aligned with the bottom cover. In other words, the guides prevent the top cover from over-extending relative to the bottom cover because of the proper spacing between the spine and the three ring metal latch. Preferably, the guides have a predetermined length "L" to provide the proper spacing between the spine and the three ring metal latch, as shown in FIG. 14. The length "L" of course may be varied depending on the configuration of the spine and the three ring latch mechanism for a particular binder.

As further shown in FIG. 14, each of the guides preferably has a notch 104 to accommodate its respective metal ring to ensure that the guides will securely mate with the metal ring. Incidentally, at rest, that is when the binder is not being handled, the guides may or may not be in direct contact with the respective metal rings. However, when the binder is being carried such that the pressure is being applied to the spine or the covers, the guides will engage with its respective metal rings. Once the notch of the guide engages with the metal ring, the spine is prevented from moving side to side relative to the three ring mechanism. That is, the guides not only align the top cover relative to the bottom cover, but they also prevent side to side movement between the top and bottom covers to minimize the stress applied to the fold lines 28', 29'. This of course prolongs the life of the fold lines 28', 29'.

Although this embodiment discloses two guide members, an embodiment with single or more than two guide members is within the scope of the present invention.

Figure 15:
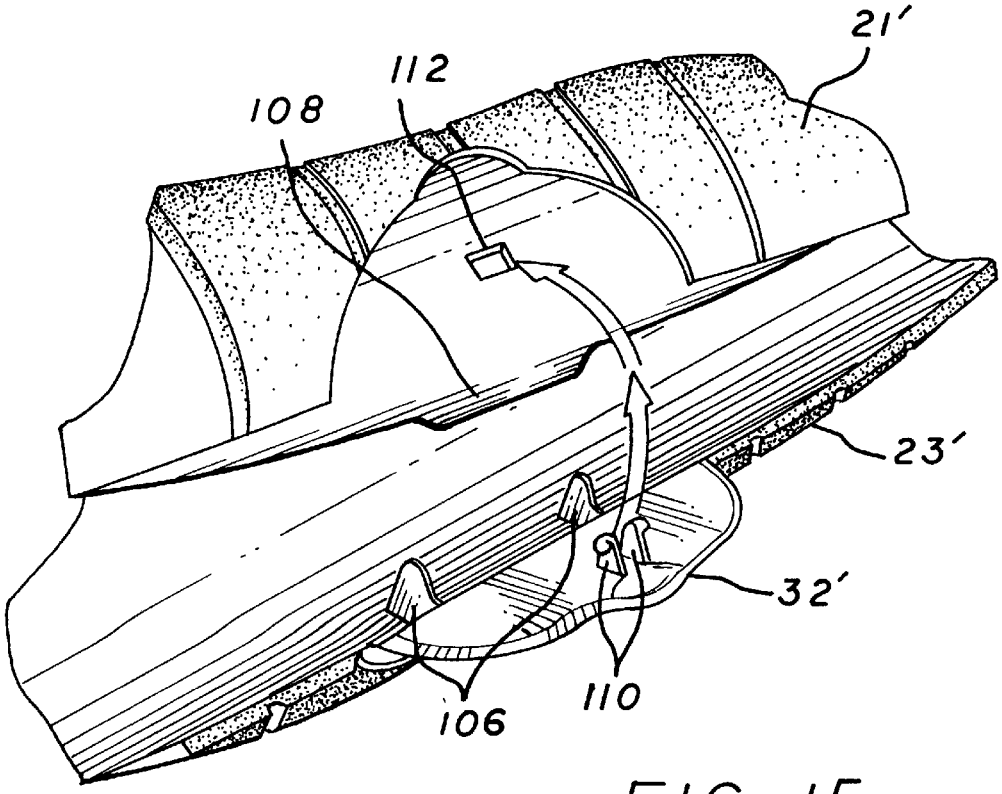
FIG. 15 is an enlarged perspective view of the right side of the binder in FIG. 12.

To further assist in aligning the top cover relative to the bottom cover, FIG. 15 shows a top tooth 108 on the mating end portion 21' of the top cover, and a pair of teeth 106 at the interior side of the bottom cover and near the end of the mating end portion 23'. The tooth 108 is positioned to associate in between the pair of teeth 106. As the top cover closes, the pair of teeth 106 guides the top tooth 108 into proper position so that the mating end portions 21', 23' are properly aligned. Note that the width of the top tooth 108 is substantially similar to the distance between the two teeth 106.

Furthermore, once the top tooth 108 is in position between the pair of teeth 106, the top tooth is prevented from moving side to side. In other words, like the guides 102, the top tooth prevents the top cover from moving side to side relative to the bottom cover. Thus, the combination of tooth and the pair of teeth minimizes the stress that may be applied to the score lines 28', 29' as the binder is applied with external forces from handling. Also, once the top tooth is engaged between the pair of teeth, the pair of teeth prevents the end portion 21' from moving laterally toward the three ring mechanism.

Figure 17:
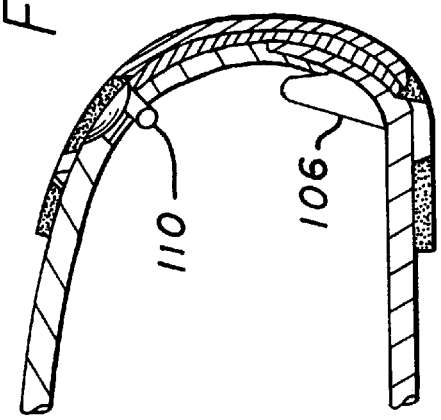
FIG. 17 is a cross sectional view along the section line 17—17 of the binder in FIG. 16.
Figure 16:
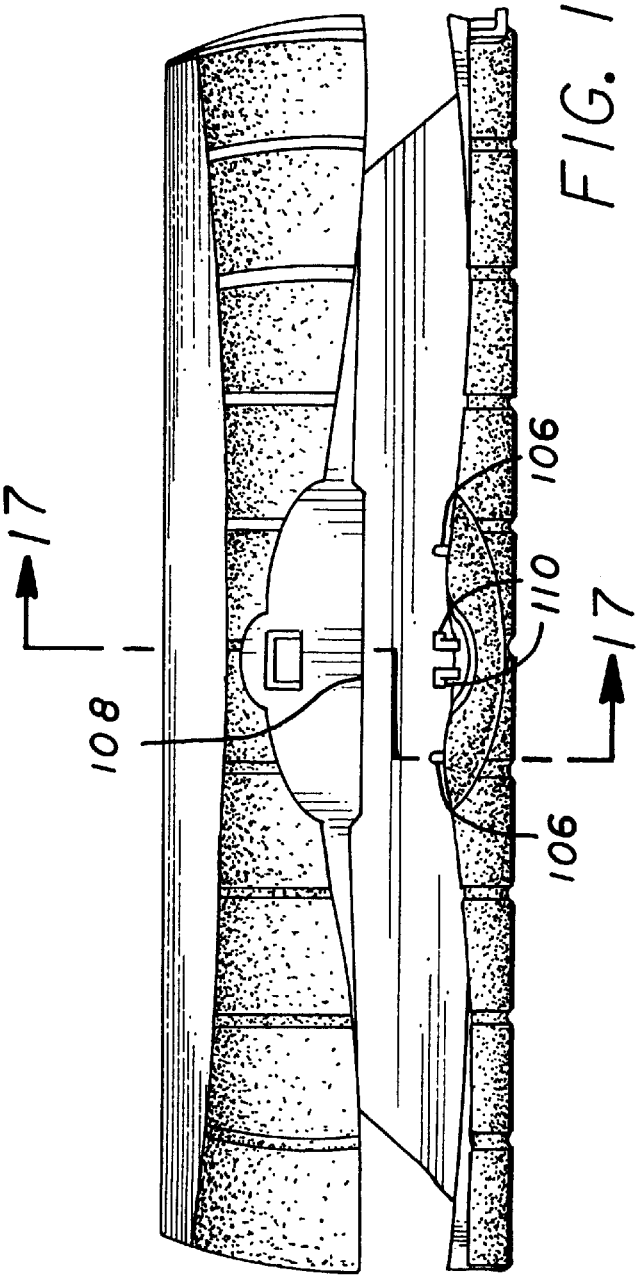
FIG. 16 is a right side view of the binder in FIG. 11 in a slightly open position.

To lock the top and bottom covers together, FIG. 15 shows a pair of latching protrusions 110 positioned to associate with an opening 112 at the mating end portion 21'. That is, the closure flap mechanism 32' is flipped over to engage the pair of latching protrusions 110 into the opening 112. Having a pair of latching protrusions independent of one another provides a more positive latching mechanism and strength to resist the covers from being pulled off unintentionally. As shown in FIGS. 16 and 17, all the features discussed above in this embodiment ensures that the front cover self-adjusts relative to the back cover for proper alignment. That is, as shown in FIG. 16, as the front cover is closed relative to the back cover, the guides 102 ensure that the front cover does not over-extend beyond the back cover. Furthermore, the guides also allow the spine to rest against the three ring metal latch to provide additional support for the front cover when the binder is compressed, handled or carried. As the front cover moves closer to the back cover, the pair of teeth 106 in conjunction with the upper tooth 108 help to further assist in aligning the front cover to the back cover, to ensure that there is no lateral misalignment between the two covers. Once the front and the back covers are in the closed position, the closer flap mechanism 32 is flipped over to lock the front and back covers together via the pair of latching protrusions 110 engaging with the opening 112 as shown in FIG. 17. Thus, the guides, the upper tooth, the pair of teeth, all work together to properly align the front and back covers together.

As shown in FIG. 14, the spine 18' is curved like the upper left quadrant of a quarter circle. As such, the transition between the spine and the top cover is much smoother than the transition between the bottom cover and the spine. Accordingly, as the top cover is opened and closed relative to the bottom cover, the hinged line 29' has a greater play than the hinged line 28'. In other words, the binder 100 with the curved spine 18' pivots mostly along hinged line 29'. One of the advantages of having a top cover that pivots substantially about the hinged line 29', rather than both hinged lines 28', 29', is that the top cover is more surely constrained to align with the bottom cover as they are closed. For example, a box with a single hinged top will always close in the same position; but if there were two equally active hinged lines, there is greater chance of misalignment. Thus, where there is a single hinge where most of the pivoting occurs, there is more accuracy in aligning the top cover relative to the bottom cover.

Of course, a spine with a plainer surface is within the scope of this invention. Preferably, in this instance, one hinge has greater play over the other hinge line, so that the two covers will align more accurately.

With regard to the pocket 44', as discussed above, the pocket 44' is preferably ultrasonically welded to the front cover 14, along the contact areas 114 as shown in FIG. 13. That is, the pocket 44' is ultrasonically welded to the cover 14 along the contact areas rather than being snapped on as disclosed in one of the previous embodiments. Preferably, a continuous ultrasonic weld is used; however, periodic spot welds are within the scope of this invention. One advantage to the ultrasonic weld is that it provides a strong coupling effect between the pocket and the cover. Strong coupling provides rigidity to the pocket itself so that it is better able to hold sheets of paper within the pocket, so that even if the binder is held upside down, the paper will not fall out. Preferably, outer edges of the pocket 44' is coupled to the cover along the bottom and the left-hand sides 116, 118, respectively, as shown in FIG. 12. This allows a user to easily insert and remove papers from the pocket, and allows the pocket to expand to hold more papers. Alternatively, a combination of mechanical interlocks, as shown in FIGS. 9–10, and ultrasonic weld may also be used to couple the pocket to the cover.

With regard to the material and welding process, any combination of material and the welding process may be used that is known to one of ordinary skill in the art. For example, materials may include (but are not limited to): rigid or semi-flexible polyvinyl chloride (PVC), ethylene vinyl acetate (EVA), polyurethane and nylon. With regard to the welding process, the pocket may be welded to the binder via a radio frequency welding or ultrasonic welding, for example. Additional coupling means such as heat sealing and adhesive may also be used. Also, the pocket need not be made of the same material as the binder.

Although the present invention has been described in terms of the preferred embodiments above, numerous modifications and/or additions to the above-described preferred embodiments would be readily apparent to one skilled in the art. Thus, by way of example but not of limitation, the mechanical interlock for holding the pocket in place could be an enlarged stud or mushroom shaped stem mating with a slightly smaller opening in the pocket. Also, a binder without the latching mechanism is within the scope of the present invention. Furthermore, where the three ring latching mechanism is coupled to the spine, the guides may protrude from one of the top or bottom covers to associate with the ring mechanism. With respect to the claims, it is applicant's intention that the claims not be interpreted in accordance with the sixth paragraph of 35 U.S.C. §112 unless the term "means" is used followed by a functional statement.

We claim:

1. A binder comprising:

a cover comprised of two portions, a top cover portion and a bottom cover portion, said top and bottom cover portions each having an inside side and an outside side, wherein said bottom cover portion has an outwardly extending free edge;

a pocket having at least three outer edges, wherein said pocket is welded to at least one of said top and bottom cover portions of said cover on said inside side of said portions along at least one outer edges of said pocket;

said cover and said pocket formed of substantially rigid material;

said cover having a spine in between said top portion and said bottom portions, and free edges opposite said spine;

a latch having a plurality of rings coupled to the bottom cover portion of said cover;

a guide protruding from said spine, wherein said guide is position to associate with one of the plurality of rings of said latch, wherein the guide positions the spine in a predetermined position to align the top cover portion relative to the bottom cover portion;

said top cover portion having a tooth, wherein said tooth has a predetermined width;

said bottom cover portion having a pair of guiding teeth adapted to receive said tooth between said pair of guiding teeth, wherein said pair of guiding teeth are separated by approximately the same distances as said predetermined width of said tooth, wherein when the top cover portion is closed relative to said bottom cover portion, said tooth of said top cover portion and said pair of guiding teeth of said bottom cover portion align the top cover portion relative to said bottom cover portion to close properly, wherein said tooth in between said pair of guiding teeth substantially prevents the top cover portion from moving side to side relative to the bottom cover portion, wherein the pair of guiding teeth protrude from the inside side of the bottom cover portion to form a gap between the pair of teeth and the outwardly extending free edge.

2. A binder of claim 1, wherein the pocket is ultrasonically welded to said at least one of said top and bottom portions of said cover on said inside side of said portions along at least one outer edges of said pocket.

3. A binder comprising:

a cover formed of two portions, a first portion, and a second portion, wherein said second portion has an outwardly extending free edge;

a hinge in between said first and second portions of said cover;

a pocket coupled to one of said first and second cover portions of said cover;

said hinge being a living hinge;

said first and second portions forming said cover and said pocket are formed of molded plastic;

said first cover portion having a tooth, wherein said tooth has a predetermined width; and said second cover portion having a pair of guiding teeth adapted to receive said tooth between said pair of guiding teeth, wherein said pair of guiding teeth are separated by approximately the same distances as said predetermined width of said tooth, wherein when the first cover portion is closed relative to said second cover portion, said tooth of said first cover portion and said pair of guiding teeth of said second cover portion align the first cover portion relative to said second cover portion to close properly, wherein said tooth in between said pair of guiding teeth substantially prevents the first cover portion from moving side to side relative to the second cover portion, wherein the second cover portion has an interior surface, wherein the pair of guiding teeth protrude from the interior surface of the second cover portion to form a gap between the pair of teeth and the outwardly extending free edge.

4. The binder of claim 3, further comprising:

a spine in between said first and second portions, said living hinge joining said spine to at least one of said first and second portions.

5. The binder of claim 4, further comprising:

a latch having a plurality of rings coupled to the second cover portion of said cover.

6. The binder of claim 5, further comprising:

a guide protruding from said spine, wherein said guide is position to associate with one of the plurality of rings of said latch, wherein the guide positions the spine in a predetermined position to align the first portion relative to the second portion.

7. The binder of claim 4, further comprising:

said first and second portions having free edges opposite said spine; and a closure fastener coupled to the free edge of said second portion, and said closure fastener adapted to releasably couple to the first portion.

8. The binder of claim 7, further comprising:

a pair of latching members protruding from said closure fastener; and said first portion having an opening position to receive said pair of latching members protruding from said closure fastener.

9. The binder of claim 3, wherein:

said pocket is defined by at least three outer edges, wherein at least one of the outer edges of said pocket is welded to one of said first and second portions of said cover.

10. The binder of claim 9, wherein:

at least one of the outer edges of said pocket is continuously welded to one of said first and second portions of said cover.

11. The binder of claim 9, wherein:

at least one of the outer edges of said pocket is ultrasonically welded to one of said first and second portions of said cover.

12. The binder of claim 9, wherein:

two adjacent outer edges of said pocket is welded to one of said first and second portions of said cover.

13. The binder of claim 3 wherein:

said first and second portions forming said cover and said pocket are formed of polypropylene plastic.

14. The binder of claim 3, wherein:

said first and second portions forming said cover and said pocket are formed of injection molded plastic.

15. The binder of claim 3, wherein:

said second portion is a bottom cover of said binder.

16. The binder of claim 4, further comprising:

a latch having a plurality of rings coupled to the spine.

17. The binder of claim 16, further comprising:

a guide protruding from one of said first and second cover portions, wherein said guide is position to associate with one of the plurality of rings of said latch, wherein the guide positions the spine in a predetermined position to align the first portion relative to the second portion.

18. A binder comprising:

a first cover portion;

a second cover portion;

a spine between the first and second cover portions, wherein the first and second cover portions are pivotally coupled to the spine, respectively;

the first cover portion having a first outwardly extending free edge;

the second cover portion having a second outwardly extending free edge;

the first cover portion having a tooth, wherein the tooth has a predetermined width; and the second cover portion having a pair of guiding teeth adapted to receive the tooth between the pair of guiding teeth, wherein the pair of guiding teeth are separated by approximately the same distances as the predetermined width of the tooth, wherein the second cover portion has an interior surface, wherein the pair of guiding teeth protrude from the interior surface of the second cover portion to form a gap between the pair of teeth and the second outwardly extending free edge.

19. A binder according to claim 18, wherein the second cover portion is the top cover portion.

20. A binder according to claim 18, wherein the pair of teeth guides the tooth into the gap between the pair of teeth and the second outwardly extending free edge when the first cover portion is being closed relative to the second cover portion.

21. A binder according to claim 18, wherein the first cover portion has an interior surface, wherein the pair of teeth is juxtaposed to the interior surface of the first cover portion when the first cover portion is closed relative to the second cover portion.

* * * * *